US012721436B2

(12) United States Patent
Zhang

(10) Patent No.: US 12,721,436 B2
(45) Date of Patent: Sep. 1, 2026

(54) ASSEMBLED DRAWER

(71) Applicant: Jiarong Zhang, Zhejiang (CN)

(72) Inventor: Jiarong Zhang, Zhejiang (CN)

( * ) Notice: Subject to any disclaimer, the term of this patent is extended or adjusted under 35 U.S.C. 154(b) by 0 days.

(21) Appl. No.: 19/231,472

(22) Filed: Jun. 7, 2025

(65) Prior Publication Data

US 2026/0174230 A1 Jun. 25, 2026

(30) Foreign Application Priority Data

Dec. 21, 2024 (CN) ..... 202423172137.3

(51) Int. Cl.
*A47B 88/90* (2017.01)

(52) U.S. Cl.
CPC ..... *A47B 88/941* (2017.01); *A47B 2230/01* (2013.01)

(58) Field of Classification Search
CPC .... A47B 88/90; A47B 88/941; A47B 2230/01
USPC ..... 312/348.1, 348.2, 108, 257.1, 334.27, 312/334, 44
See application file for complete search history.

(56) References Cited

U.S. PATENT DOCUMENTS 5,466,058 A * 11/1995 Chan ..... A47B 95/02 312/109
5,839,806 A * 11/1998 Liu ..... A47B 67/04 312/265.5
5,913,581 A * 6/1999 Stephan ..... B60R 11/02 248/223.41
6,474,759 B2 * 11/2002 Hsu ..... F16B 12/26 312/263
6,883,882 B2 * 4/2005 Lin ..... A47B 47/042 312/265.5
7,967,401 B2 * 6/2011 Hsu ..... A47B 47/0033 312/111
8,388,073 B2 * 3/2013 Richter ..... A47B 47/025 312/263
10,085,553 B2 * 10/2018 Fünfgeld ..... A47B 47/042
2006/0250052 A1 * 11/2006 Davis ..... F16B 12/26 312/107
2010/0181881 A1 * 7/2010 Hsu ..... A47B 87/0292 312/257.1
2014/0333188 A1 * 11/2014 Harold ..... B42F 21/00 312/257.1
2015/0008814 A1 * 1/2015 Yamamoto ..... A47B 87/0292 312/334.27

* cited by examiner

*Primary Examiner* — James O Hansen
(74) *Attorney, Agent, or Firm* — Hawaii Patent Services; Nathaniel K. Fedde; Kenton N. Fedde

(57) ABSTRACT

The present invention provides an assembled drawer, comprising a base plate; a guard plate, which is combined with the base plate to form an accommodating cavity with an opening, and comprises a first guard plate and a second guard plate detachably mounted on the base plate; a support plate, which is slidably mounted on the base plate; a guide rail assembly, which is arranged between the base plate and the support plate, and comprises a slide groove arranged on the base plate, and a slide plate arranged on the support plate; an L-shaped plate, which is arranged between the base plate and the second guard plate, and the L-shaped plate can prevent the second guard plate from swinging relative to the base plate.

16 Claims, 7 Drawing Sheets

ASSEMBLED DRAWER

CROSS-REFERENCE TO RELATED APPLICATIONS

This application claims priority to Chinese Patent Application No. 202423172137.3, filed on Dec. 21, 2024, entitled "Assembled drawers", the entire contents of which and its amendments are incorporated herein by reference.

TECHNICAL FIELD

The present invention relates to the technical field of furniture, and in particular to an assembled drawer.

BACKGROUND

With the improvement of living standards, people have higher requirements for the efficient utilization of home space. Assembled drawers can be flexibly combined according to different space sizes and shapes, better adapt to various furniture and room layouts, and meet people's diverse needs for storage space.

In the prior art, the assembly-type drawer employs an integrated pulling mechanism, where excessive pulling range may cause tipping. Additionally, the lack of additional stabilizing components may result in wobbling of the side second guard plates.

The existing U.S. Pat. No. 9,131,773 discloses "Combination drawer assembly and method of assembling the same", which includes a bottom frame and a support frame, a seat rail, a basket drawer, and a top frame, and specifically discloses the assembly and disassembly of the drawer; U.S. Patent No. 20060103279 proposes "Drawer assembly with a stop mechanism", in which the drawer has a first extended position and a second extended position, and is composed of two vertical second guard plates, two slide rails, a drawer, and a stop mechanism including a stop member and a positioning member. The second guard plates and the slide rail are the main supporting structures, and the stop mechanism is used to control the moving position of the drawer and prevent accidental removal. This allows the drawer to be extended and retracted to facilitate the storage and retrieval of items.

However, with prolonged use, the disclosed drawer may exhibit issues such as wobbling or jamming during operation, ultimately compromising the user experience.

SUMMARY

The present invention provides an assembled drawer to solve the problems raised by the above background technology.

In order to achieve the above-mentioned invention object, the present invention adopts the following technical solutions:

An assembled drawer comprises a base plate, a guard plate is connected to the base plate, a support plate is slidably connected to the base plate or the guard plate, and the support plate and the guard plate form an accommodating cavity for storing objects.

The present invention also provides an assembled drawer, comprising a base plate; a guard plate, which encloses the base plate to form an accommodating cavity with an opening, and includes a first guard plate and a second guard plate detachably mounted on the base plate; a support plate, which is slidably mounted on the base plate; a guide rail assembly, which is arranged between the base plate and the support plate, and comprises a slide groove arranged on the base plate, and a slide plate arranged on the support plate; an L-shaped plate, which is arranged between the base plate and the second guard plate; wherein the slide plate and the slide groove cooperate to enable the support plate to slide back and forth along the slide plate and approach or move away from the accommodating cavity through the opening, and when the support plate slides, the L-shaped plate can prevent the second guard plate from swinging relative to the base plate.

BRIEF DESCRIPTION OF DRAWINGS

The accompanying drawings, which form a part of this application, are provided to further illustrate the invention. The illustrative embodiments and their descriptions serve to explain the invention and do not constitute an undue limitation thereof. In the drawings.

Figure 1:
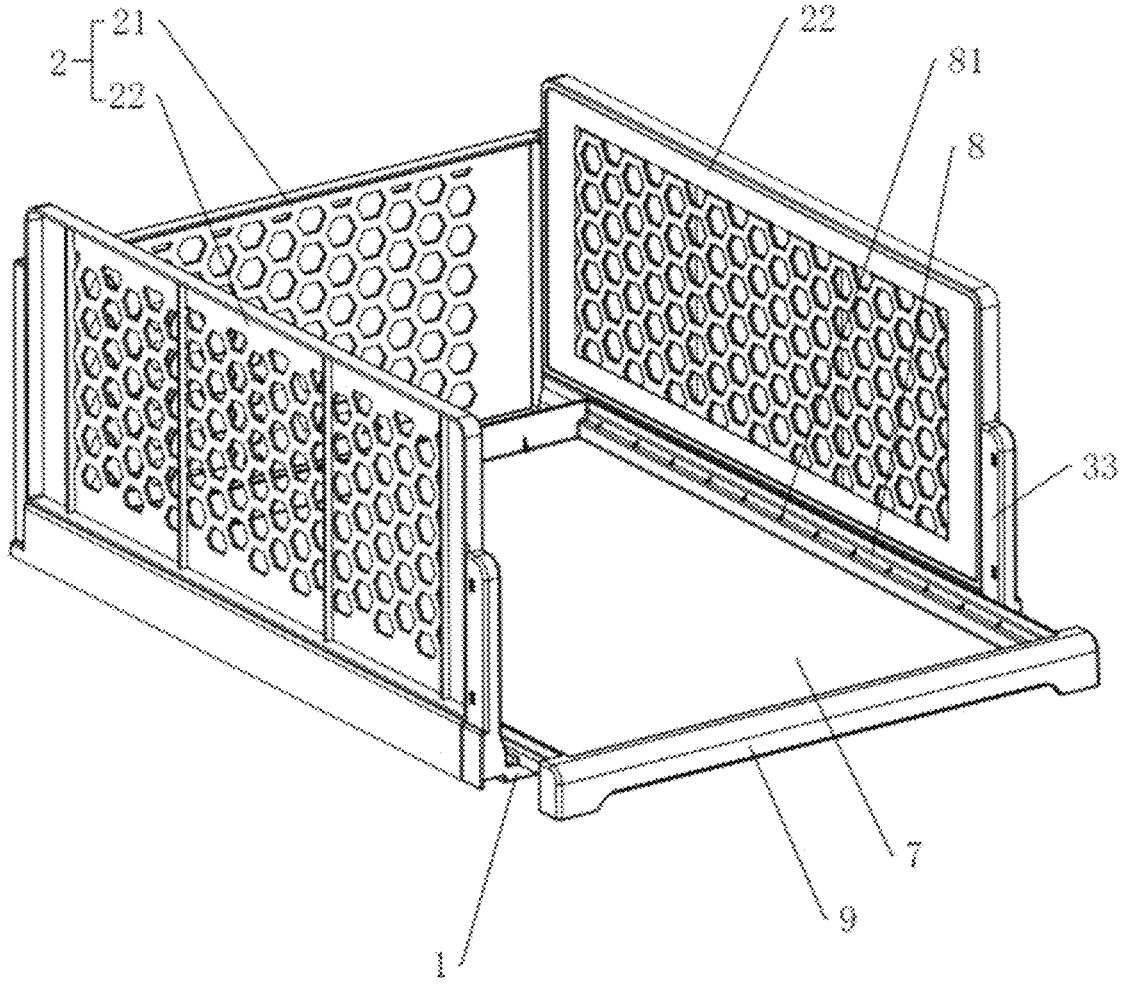
FIG. 1 is a schematic structural diagram of the present invention.

Figure numerals: 1. base plate; 10. accommodating cavity; 11. opening; 12. stacking groove; 13. stabilizing member; 2. guard plate; 21. first guard plate; 22. second guard plate; 31. first anti-detachment block; 32. second anti-detachment block; 33. L-shaped plate; 34. first anti-detachment groove; 35. second anti-detachment groove; 36. trapezoidal block; 37. fixing groove; 41. fixing plate; 42. limiting groove; 43. limiting plate; 44. clamping plate; 51. T-shaped slot; 52. protrusion; 53. T-shaped plate; 54. buckle; 61. guide plate; 62. slide groove; 63. discharge groove; 7. support plate; 71. slide plate; 8. surrounding plate; 81. anti-detachment plate; 9. grip plate; 91. reinforcing plate; 92. groove.

DESCRIPTION OF EMBODIMENTS

The technical solutions in the embodiments of the present invention will be described clearly and completely below in conjunction with the drawings in the embodiments of the present invention. Obviously, the described embodiments are part of the embodiments of the present invention, not all of the embodiments. The following description of at least one exemplary embodiment is actually illustrative and is by no means intended to limit the present invention and its application or use. All other embodiments obtained by ordinary technicians in this field, without creative work based on the embodiments of the present invention are within the scope of protection of the present invention.

It should be noted that the terms used herein are only for describing specific embodiments and are not intended to limit the exemplary embodiments according to the present application. As used herein, unless the context clearly indicates otherwise, the singular form is also intended to include the plural form. In addition, it should be understood that when the terms "comprise" and/or "include" are used in this specification, it indicates the presence of features, steps, operations, devices, components, and/or combinations thereof.

Unless otherwise specifically stated, the relative arrangement of the components and steps described in these embodiments, as well as numerical expressions and values do not limit the scope of the present invention. Additionally, it should be understood that, for ease of description, the sizes of the various components depicted in the accompanying drawings are not drawn according to the actual proportional relationship. The technology, methods and equipment familiar to skilled practitioners in the relevant field may not be discussed in detail; however, in appropriate contexts, the technology, methods and equipment should be regarded as a part of the authorized specification. In all examples shown and discussed here, any specific value should be interpreted as exemplary, rather than as a limitation. Therefore, other examples of exemplary embodiments may have different values. It should be noted that similar reference numerals and letters represent similar items in the following drawings; therefore, once a particular item is defined in an accompanying drawing, it does not need to be further discussed in subsequent drawings.

As shown in FIGS. 1 to 5, the assembled drawer comprises a base plate 1, a guard plate 2 is connected to the base plate 1, and a support plate 7 is slidably connected to the base plate 1. The support plate 7 serves as a load-bearing component for users to store items. The guard plate 2 includes a first guard plate 21 and two second guard plates 22; the first guard plate 21 is detachably fixed to one side of the base plate 1, and the two second guard plates 22 are detachably fixed to opposite sides of the support plate 7, and are enclosed with the base plate 1 to form an accommodating cavity 10 with an opening 11, and the support plate 7 approaches or moves away from the accommodating cavity 10 through the opening 11; an L-shaped plate 33 is also arranged between the base plate 1 and the second guard plate 22, and the L-shaped plate 33 can prevent the second guard plate 22 from swinging relative to the base plate 1 during use, thereby enhancing the stability of the structure.

Figure 2:
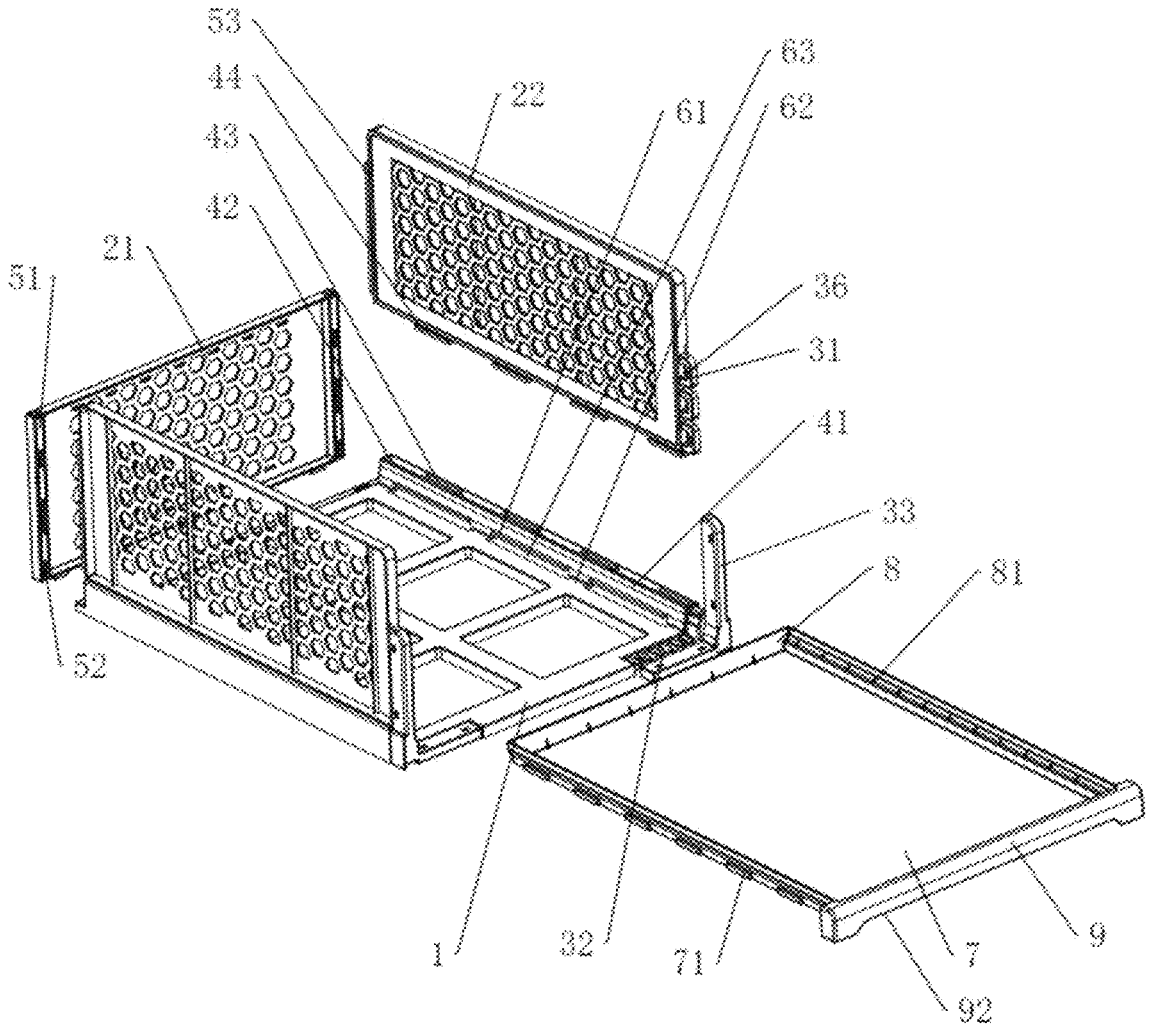
FIG. 2 is an exploded schematic diagram of the present invention.
Figure 3:
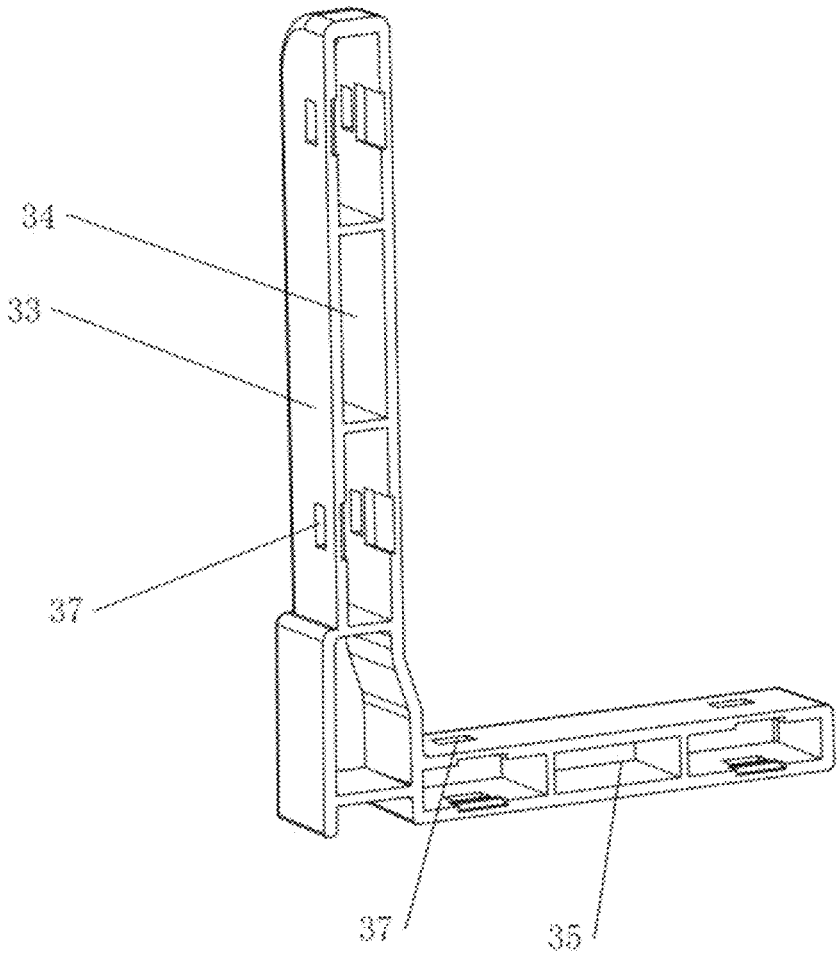
FIG. 3 is a schematic structural diagram of an L-shaped plate of the present invention.

Please refer to FIGS. 1, 2, and 3. In this embodiment, three first anti-detachment blocks 31 are positioned on the side of the second guard plate 22 close to the opening 11, and the three first anti-detachment blocks 31 are arranged along the width direction of the second guard plate 22; a second anti-detachment block 32 is provided on the side of the base plate 1 facing away from the first guard plate 21, and six second anti-detachment blocks 32 are provided along the width direction of the base plate 1, and the six second anti-detachment blocks 32 are provided in groups of three on both sides close to the second guard plate 22. The first anti-detachment groove 34 and the second anti-detachment groove 35 are respectively provided at both ends of the L-shaped plate 33. The L-shaped plate 33 realizes a double stable connection between the second guard plate 22 and the base plate 1 by engaging the first anti-detachment groove 34 with the first anti-detachment block 31 on the second guard plate 22, and engaging the second anti-detachment groove 35 with the second anti-detachment block 32 on the base plate 1, thereby improving the anti-twisting and anti-shearing capabilities of the second guard plate 22.

Please refer to FIGS. 1 and 3. In this embodiment, the L-shaped plate 33 is constructed from elastic plastic, such as polypropylene, which offers excellent elasticity and fatigue resistance. This material choice ensures that optimal fixing performance is maintained during prolonged use. The lengths of the two ends of the L-shaped plate 33 can be tailored to specific usage scenarios and can be designed as either an equal-length structure or an asymmetric structure, featuring one long end and one short end, to accommodate varying force requirements. The L-shaped plate 33 is positioned adjacent to the opening 11 of the accommodating cavity 10. During the sliding process of the support plate 7, it enhances the connection strength between the second guard plate 22 and the base plate 1, thereby preventing lateral swinging of the second guard plate 22 relative to the base plate 1 and improving both connection strength and anti-deformation resistance.

Please refer to FIGS. 2 and 3. In this embodiment, trapezoidal blocks 36 are provided on the surfaces of the first anti-detachment block 31 and the second anti-detachment block 32. A fixing groove 37 is opened on the L-shaped plate 33. The trapezoidal block 36 is used to be embedded in the fixing groove 37 for clamping. This configuration prevents the L-shaped plate 33 from loosening during prolonged use, which could lead to the L-shaped plate 33 detaching and causing the second guard plate 22 to shake, ultimately resulting in an unstable structure.

In other embodiments (not shown in the figures), the L-shaped plate 33, the second guard plate 22 and the base plate 1 may be connected by screws.

Figure 4:
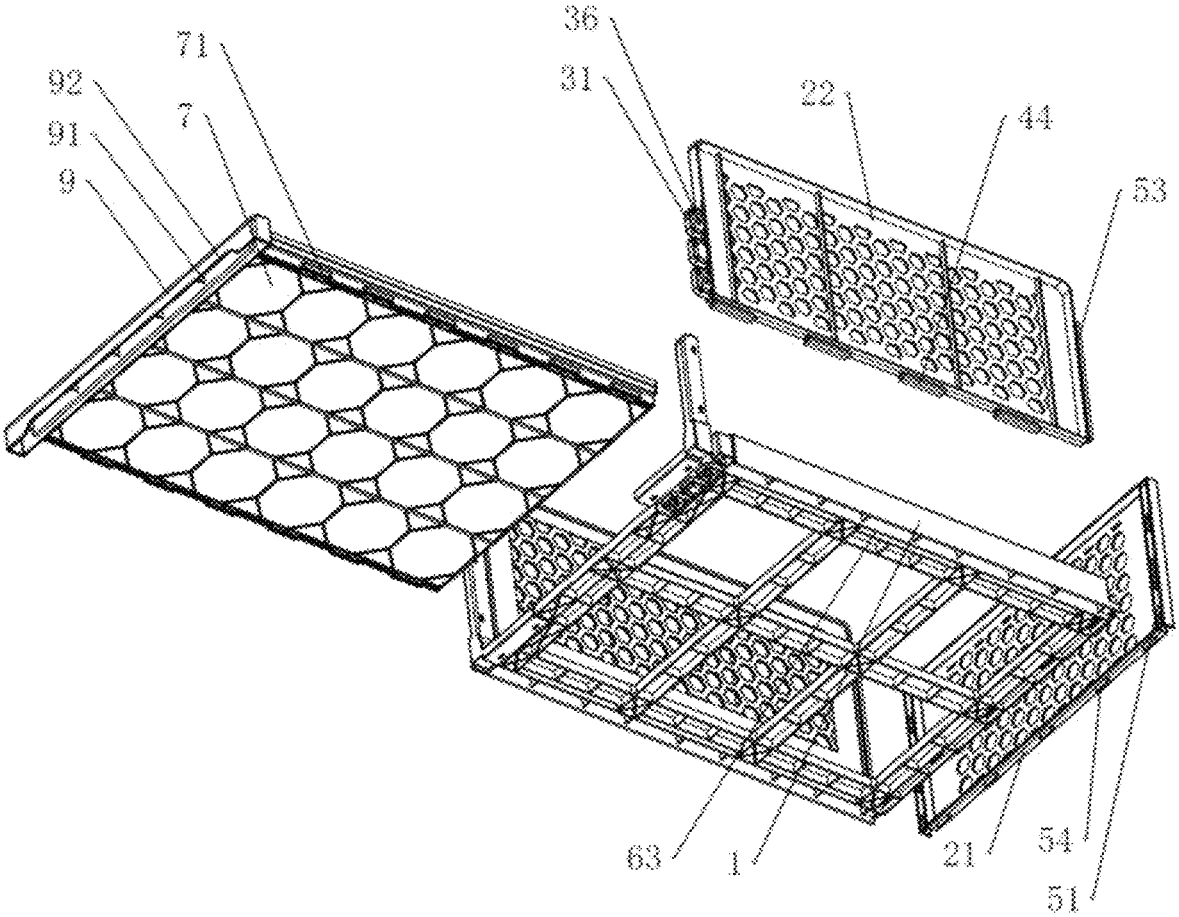
FIG. 4 is an exploded schematic diagram of the present invention from another perspective.

Please refer to FIGS. 1, 2, and 4. In this embodiment, a fixing plate 41 is formed by extending upward from both sides of the base plate 1. A limiting groove 42 is provided on the fixing plate 41. The length direction of the fixing plate 41, the length direction of the base plate 1, and the length direction of the limiting groove 42 are parallel. Eight limiting plates 43 are provided on the inner wall of the limiting groove 42. The limiting plates 43 are arranged at intervals along the length direction of the fixing plate 41, and there is a gap between two corresponding limiting plates 43. Four clamping plates 44 are provided on the side of the second guard plate 22 facing the fixing plate 41. The four clamping plates 44 are arranged at intervals along the length direction of the second guard plate 22. Align the clamping plate 44 with the limiting groove 42 between the limiting plates 43, and insert it into the groove. Move the clamping plate 44 along the length direction of the limiting groove 42 until it aligns with the limiting plates 43, allowing them to engage with one another. This action secures the connection and fixation between the second guard plate 22 and the base plate 1. Next, move the L-shaped plate 33 toward the base plate 1, the first anti-detachment block 31 is embedded in the first anti-detachment groove 34, the second anti-detachment block 32 is embedded in the second anti-detachment groove 35. Simultaneously, the trapezoidal block 36 is used to be embedded in the fixing groove 37, thereby realizing the fixed connection between the second guard plate 22 and the base plate 1.

The cross section of the clamping plate 44 is in a "T" shape, and a mounting opening is set at one end of the limiting groove 42 and the cross section is a "T"-shaped groove. Through the above-mentioned T-shaped clamping plate 44 and T-shaped limiting groove 42 structure, the second guard plate 22 and the base plate 1 are quickly assembled without tools, while ensuring the high strength of the connection and the long-term durability after multiple disassembly and assembly.

In other embodiments (not shown in the figures), the cross section of the clamping plate 44 may also be a trapezoidal cross section, and the limiting groove 42 is a matching trapezoidal groove.

Please refer to FIGS. 1, 2, and 4. In this embodiment, a T-shaped slot 51 and a buckle 54 are provided on the first guard plate 21. The length direction of the T-shaped slot 51 is parallel to the width direction of the first guard plate 21. A protrusion 52 is fixedly connected to the inner wall of the T-shaped slot 51. A plurality of protrusions 52 are arranged at intervals along the length direction of the T-shaped slot 51 and correspond to each other in pairs. A T-shaped plate 53 slidably connected to the T-shaped slot 51 is provided on the side of the second guard plate 22 facing the first guard plate 21, and the protrusion 52 is used to engage with the T-shaped plate 53. The buckle 54 is provided on the side close to the base plate 1, and a corresponding slot is provided on the base plate 1 to engage with it.

After the second guard plate 22 is fixed to the base plate 1, the intervals between the protrusions 52 of the first guard plate 21 are aligned with the T-shaped plate 53 of the second guard plate 22. Subsequently, the first guard plate 21 is slid downward, allowing the T-shaped plate 53 is slidably connected to the T-shaped slot 51 and snapped with the protrusions 52, thereby realizing the detachable connection between the first guard plate 21 and the second guard plate 22. As the first guard plate 21 continues to move toward the base plate 1, the buckle 54 snaps into the snap slot to fix the first guard plate 21 on the base plate 1, thereby fixing the first guard plate 21 and making its connection more stable. The snap-fitting mechanism between the L-shaped plate 33, the second guard plate 22, and the base plate 1 enables the second guard plate 22 to jointly enhance the rigidity of the overall structure when subjected to forces in multiple directions, thereby avoiding problems such as loosening, swinging, or structural deformation caused by the sliding of the support plate 7 or the action of external forces.

In other embodiments (not shown in the figures), the cross section of the T-shaped plate 53 may also be a trapezoidal cross section, and the T-shaped slot 51 is a trapezoidal groove matching therewith.

Please refer to FIGS. 1, 2, and 4. In this embodiment, a guide plate 61 is provided on the side wall of the fixing plate 41, and a slide groove 62 is formed between the guide plate 61 and the bottom wall of the base plate 1. The length direction of the guide plate 61 is parallel to the length direction of the base plate 1; an discharge groove 63 is provided on the base plate 1, and the discharge groove 63 is arranged opposite to the guide plate 61; a slide plate 71 slidably connected to the slide groove 62 is provided on the side wall of the support plate 7. Through the cooperation of the slide groove 62 and the slide plate 71, the support plate 7 can reciprocate along the slide groove 62, so that the support plate 7 can slide independently relative to the base plate 1. This design facilitates the storage and retrieval of items for users. The cooperation of the guide plate 61 and the slide groove 62 makes the sliding smoother, ensuring that the support plate 7 can be opened and closed smoothly under different loads, thereby improving the convenience and safety of users storing and retrieving items.

Moreover, the detachable guard plate 2 is more convenient for storage and transportation. When the user does not need it, the guard plate 2 can be separated from the base plate 1, and the guard plate 2 can also be disassembled separately to make it easier to store. The detachable structure is also easier to pack, which can reduce the occupied area and storage space, thereby reducing transportation and storage costs.

In other embodiments (as shown in the figure), the slide groove 62 may be set on the side wall of the second guard plate 22, and the support plate 7 may slide separately; the slide grooves 62 can also be set on both the base plate 1 and the second guard plate 22, and they can be spaced a certain distance apart. Users can choose different slide grooves 62 to install according to their needs, or multiple support plates 7 can be installed. Each layer of support plates 7 can slide out independently to form a multi-layer support plate 7 structure to meet the personalized needs of users.

Figure 5:
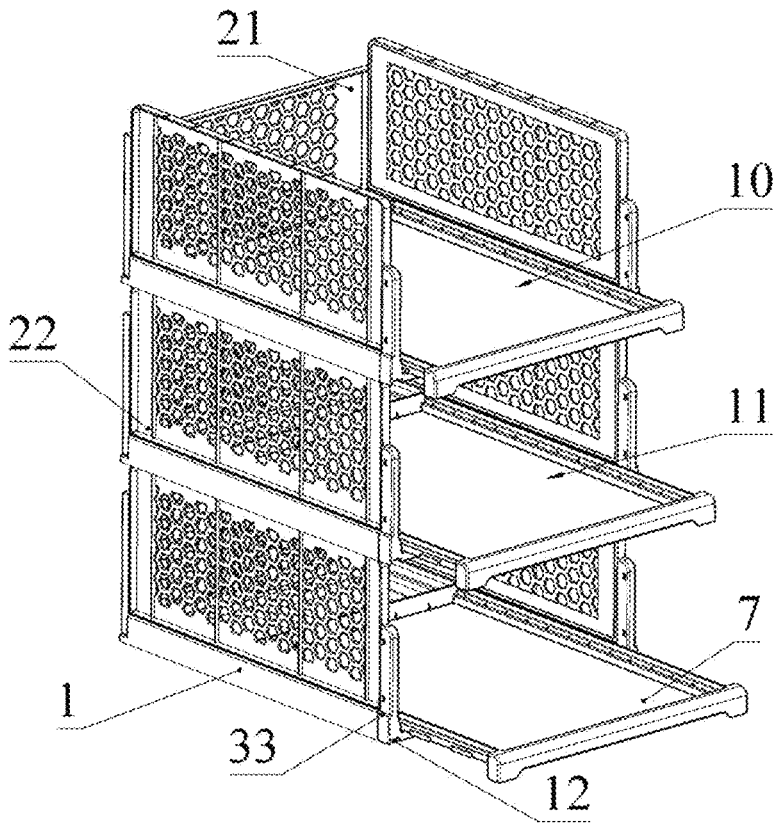
FIG. 5 is a schematic diagram of a three-layer stacked state of the assembled drawers of the present invention.

Please refer to FIGS. 2 and 5. In this embodiment, a surrounding plate 8 is fixedly connected to the side of the support plate 7 facing away from the base plate 1. The surrounding plate 8 is U-shaped and close to the edge of the support plate 7. A plurality of anti-detachment plates 81 with a reinforcing function are fixedly connected between the surrounding plate 8 and the support plate 7; a grip plate 9 is fixedly connected to the side wall of the support plate 7. The grip plate 9 is hollow and is used for the user's fingers or palms to grasp it and apply force; a reinforcing plate 91 is fixedly connected to the inner wall of the grip plate 9. A groove 92 is provided on the grip plate 9. The groove 92 is connected to the inner wall of the grip plate 9. The support plate 7 can be pulled close to or away from the accommodating cavity 10 through the grip plate 9, so that it is convenient for users to store items.

Please refer to FIG. 5. In this embodiment, a stacking groove 12 is also provided at the bottom of the base plate 1 and is symmetrically distributed on both sides. The stacking groove 12 is a long strip-shaped groove extending along the length direction of the base plate 1. Through the stacking groove 12, it can be stacked on the upper end of the second guard plate 22 of another assembled drawer. Anti-slip textures or friction pads can be added between the stacking grooves 12 and the second guard plate 22 to increase friction, ensuring a more stable stacking arrangement; users can freely adjust the number of assembled drawers for multi-layer stacking according to actual storage needs, so as to adapt to different usage scenarios and user needs.

Figure 6:
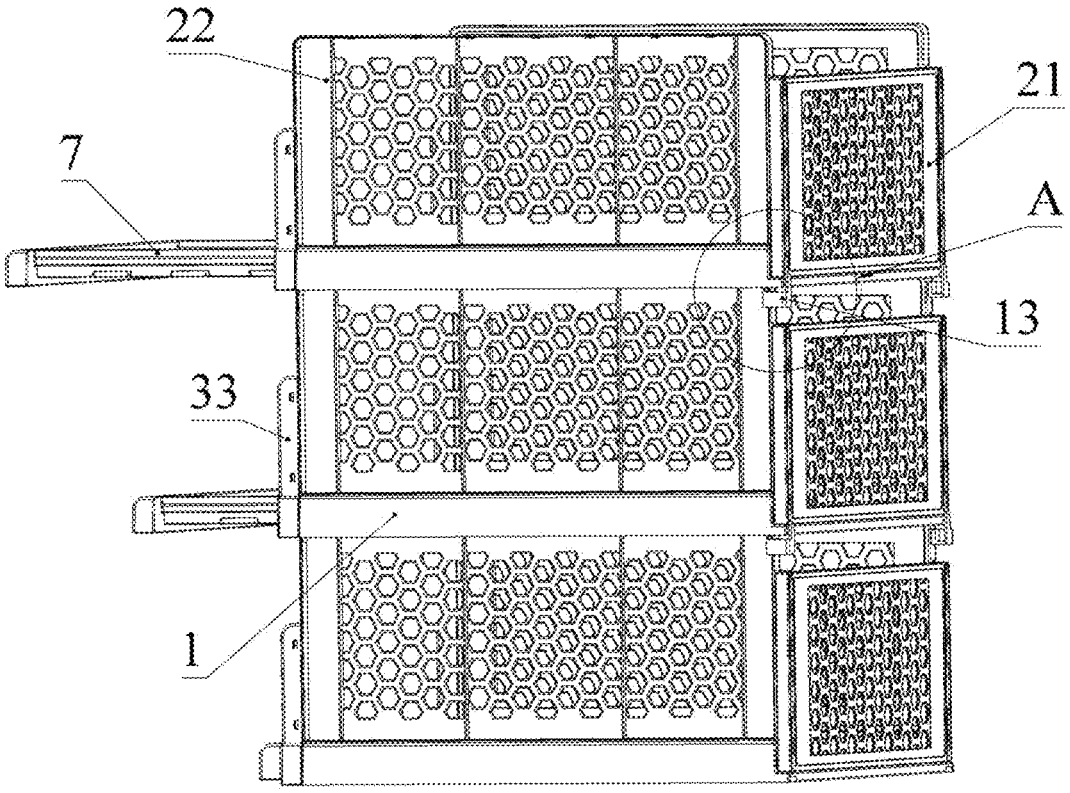
FIG. 6 is a schematic diagram of a three-layer stacked state of the assembled drawers of the present invention from another perspective.
Figure 7:
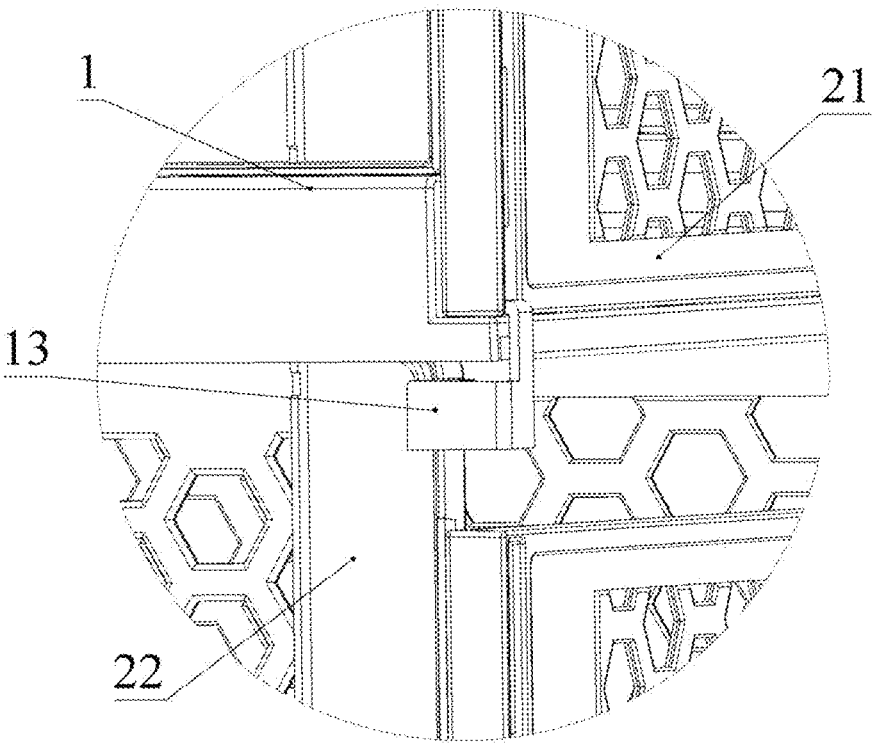
FIG. 7 is a partial enlarged view of portion A in FIG. 6.

Please refer to FIGS. 6 and 7. In this embodiment, in order to further improve the structural stability and safety of the assembled drawers during multi-layer stacking, a stabilizing member 13 is provided between the upper and lower assembled drawers to enhance the reliability of the stacking connection and prevent the assembled drawers from shaking, shifting or tipping over due to the forward shift of the center of gravity. The stabilizing member 13 is provided at one end close to the first guard plate 21, one end of which can be snapped onto the second guard plate 22 of the next assembled drawer, and the other end can be snapped onto the base plate 1 of the previous assembled drawer. When in use, first snap one end of the stabilizing member 13 onto the second guard plate 22 of the next assembled drawer. On the second guard plate 22 of the drawer, the upper assembled drawer is slid along the stacking groove 12 until the base plate 1 is engaged with the other end of the stabilizing member 13. The setting of the stabilizing member 13 can prevent the upper assembled drawer from swaying or shifting laterally due to sliding or external force after stacking; when the user pulls out the support plate 7 to store or access items, the stabilizing member 13 can provide reverse supporting force to offset the downward gravity torque generated by pulling out the support plate 7, thereby preventing the overall structure from overturning due to the forward shift of the center of gravity; in a multi-layer usage scenario, the stabilizing member 13 can enhance the stability of the overall structure and improve the safety factor during use.

In summary, it can be seen from the above description that the present invention achieves the following technical effects:

The cooperation of the slide plate 71 and the slide groove 62 allows the support plate 7 to slide out independently, especially when the assembled drawers are stacked in multiple layers, which makes it more convenient for users to store and retrieve items; and the snap-on structure allows for rapid and lossless assembly and disassembly of the components. At the same time, an L-shaped plate 33 is arranged between the base plate 1 and the second guard plate 22 to enhance the second guard plate 22's anti-twisting and anti-shearing capabilities, thereby avoiding accidents caused by structural instability due to swinging during use; and the assembled drawers can be stacked according to actual needs, with the number of layers freely increased or decreased to meet different storage needs.

In the description of the present invention, it is necessary to understand that the directions or positional relationships indicated by directional words such as "front, back, up, down, left, right", "lateral, vertical, perpendicular, horizontal" and "top, bottom" are usually based on the directions or positional relationships shown in the drawings. They are only for the convenience of describing the present invention and simplifying the description. Unless otherwise specified, these directional words do not indicate or imply that the devices or elements referred to must have a specific direction or be constructed and operated in a specific direction. Therefore, they cannot be understood as limiting the scope of protection of the present invention. The directional words "inside and outside" refer to the inside and outside relative to the contours of each component itself.

For ease of description, spatial relative terms such as "on," "above," "upper surface," and "upper" may be used herein to describe the spatial positional relationships between a device or feature and other devices or features, as shown in the accompanying drawings. It should be understood that spatially relative terms are intended to include different orientations of the device in use or operation, in addition to the orientation described in the figure. For example, if the device in the accompanying drawings is inverted, the device described as "above other devices or structures" or "on the top of other devices or structures" will be positioned as "below other devices or structures" or "under other devices or structures". Thus, the exemplary term "above" can include both "above" and "below." The device may also be positioned in other different ways (rotated 90 degrees or in other orientations), and the spatially relative descriptions used here should be interpreted accordingly.

In addition, it should be noted that the use of terms such as "first" and "second" to limit components is to facilitate the distinction between corresponding components. Unless otherwise stated, the above terms have no special meaning and therefore cannot be understood as limiting the scope of protection of the present invention.

The above are only preferred embodiments of the present invention and are not intended to limit the present invention. For those skilled in the art, the present invention may have various modifications and variations. Any modification, equivalent replacement, improvement, etc. made within the spirit and principles of the present invention shall be included in the protection scope of the present invention.

What is claimed is:

1. An assembled drawer, comprising:

a base plate;

a support plate:

a guard plate connected to the base plate, wherein the base plate or the guard plate is slidably connected to the support plate, and the support plate and the guard plate define an accommodating cavity for storing objects; and a fixing plate is fixedly connected to a side wall of the base plate, a limiting groove is provided on the fixing plate, a plurality of limiting plates are fixedly connected to an inner wall of the limiting groove;

wherein the guard plate includes a first guard plate and two second guard plates, the first guard plate is fixed to one side of the base plate, and the two second guard plates are respectively fixed to opposite sides of the support plate, and the support plate moves along the base plate toward or away from the first guard plate;

wherein a guide plate is fixedly connected to the base plate, a slide groove is formed between the guide plate and a bottom wall of the base plate, and a slide plate is fixedly connected to a side wall of the support plate and slidably connected to the slide groove.

2. The assembled drawer according to claim 1, wherein the base plate is provided with a discharge groove, and the discharge groove is arranged opposite to the guide plate.

3. The assembled drawer according to claim 1, wherein a grip plate is fixedly connected to a side wall of the support plate, the grip plate is hollow, a reinforcing plate is fixedly connected to an inner wall of the grip plate, a groove is formed on the grip plate, and the groove is connected to the inner wall of the grip plate.

4. The assembled drawer according to claim 1, wherein the guide plate is fixed to a side wall of the fixing plate, a gap is provided between two limiting plates of the plurality of limiting plates, a first clamping plate is fixedly connected to a side of one of said two second guard plates facing the fixing plate, a second clamping plate is fixedly connected to a side of another of said two second guard plates facing the fixing plate and the first clamping plate is slidably connected to the limiting groove and is used to abut against a limiting plate of the plurality of limiting plates.

5. The assembled drawer according to claim 1, the first guard plate is provided with a T-shaped slot, and a protrusion is fixedly connected to an inner wall of the T-shaped slot, a side of each of the second guard plates facing the first guard plate is fixedly connected with a T-shaped plate, which is slidably engaged in the T-shaped slot, the protrusion is configured to abut against the T-shaped plate to restrict movement.

6. The assembled drawer according to claim 1, wherein the first guard plate is connected to the base plate by a buckle.

7. An assembled drawer, comprising:

a base plate;

a support plate:

a guard plate connected to the base plate, wherein the guard plate includes a first guard plate and two second guard plates, the first guard plate is fixed to one side of the base plate, and the two second guard plates are respectively fixed to opposite sides of the support plate, wherein the base plate or the guard plate is slidably connected to the support plate, and the support plate and the guard plate define an accommodating cavity for storing objects, and the support plate moves along the base plate toward or away from the first guard plate;

wherein a guide plate is fixedly connected to the base plate, a slide groove is formed between the guide plate and a wall of the base plate, and a slide plate is fixedly connected to a side wall of the support plate and slidably connected to the slide groove; and an L-shaped plate, a first anti-detachment block is fixedly connected to a side wall of the second guard plate, a second anti-detachment block is fixedly connected to a side of the base plate facing away from the first guard plate, a first anti-detachment groove and a second anti-detachment groove are opened on the L-shaped plate, the first anti-detachment block is embedded in the first anti-detachment groove, and the second anti-detachment block is embedded in the second anti-detachment groove.

8. An assembled drawer, comprising:

a base plate;

a guard plate, which is combined with the base plate to define an accommodating cavity with an opening, the guard plate comprises a first guard plate and a second guard plate detachably mounted on the base plate;

a support plate slidably mounted on the base plate;

a guide rail assembly is arranged between the base plate and the support plate, wherein the guide rail assembly comprises a slide groove arranged on the base plate and a slide plate arranged on the support plate;

an L-shaped plate disposed between the base plate and the second guard plate;

the slide plate and the slide groove cooperate to allow the support plate to slide back and forth along the slide plate and move closer to or away from the accommodating cavity through the opening, and when the support plate slides, the L-shaped plate prevents the second guard plate from swinging relative to the base plate;

a first anti-detachment groove and a second anti-detachment groove are respectively provided at both ends of the L-shaped plate;

the second guard plate is provided with a first anti-detachment block on a side adjacent to the L-shaped plate, and the base plate is provided with a second anti-detachment block near the opening; and the L-shaped plate and the second guard plate are clamped together by the first anti-detachment block and the first anti-detachment groove, and the L-shaped plate and the base plate are clamped together by the second anti-detachment block and the second anti-detachment groove.

9. The assembled drawer according to claim 8, wherein the L-shaped plate is arranged on one side of the opening, one end of the L-shaped plate is clamped with the base plate, and another end of the L-shaped plate is clamped with the second guard plate.

10. The assembled drawer according to claim 9, wherein the second guard plate and the first guard plate are detachably connected via a snap-fit structure.

11. The assembled drawer according to claim 10, wherein the snap-fit structure comprises a T-shaped plate arranged on the second guard plate, and a T-shaped slot arranged on the first guard plate.

12. The assembled drawer according to claim 9, wherein a fixing plate is integrally formed on the base plate.

13. The assembled drawer according to claim 9, is wherein a clamping plate is provided on one side of the second guard plate close to the base plate, a limiting groove is correspondingly provided on the base plate, and the second guard plate and the base plate are detachably clamped via the clamping plate and the limiting groove.

14. The assembled drawer according to claim 9, wherein a grip plate is provided on one side of the opening of the support plate, and the support plate can be pulled close to or away from the first guard plate by the grip plate.

15. The assembled drawer according to claim 9, wherein a stacking groove is also provided at a bottom of the base plate, through which the assembled drawer can be stacked on another assembled drawer.

16. The assembled drawer according to claim 8, wherein the L-shaped plate is provided with a first anti-detachment groove at a first end thereof and a second anti-detachment groove at a second end thereof.

* * * * *